US006095845A

United States Patent [19]

Murphy

[11] Patent Number: 6,095,845

[45] Date of Patent: Aug. 1, 2000

[54] TANGLE RESISTANT CABLE CONNECTOR

[76] Inventor: Stephen C. Murphy, 1369 N. Rutledge Ave., Meridian, Id. 83642

[21] Appl. No.: 09/231,309

[22] Filed: Jan. 13, 1999

[51] Int. Cl.[7] ..... H01R 13/627

[52] U.S. Cl. ..... 439/364

[58] Field of Search ..... 439/304, 359, 439/362, 364, 372

[56] References Cited

U.S. PATENT DOCUMENTS

| | | | |
|---|---|---|---|
| 4,781,330 | 11/1988 | Atkins | 439/359 |
| 5,098,312 | 3/1992 | Raczynski | 439/362 |
| 5,190,465 | 3/1993 | Galinis et al. | 439/304 |
| 5,219,242 | 6/1993 | Liaw | 403/380 |
| 5,288,241 | 2/1994 | Galinis et al. | 439/304 |
| 5,288,244 | 2/1994 | Lien | 439/362 |
| 5,383,795 | 1/1995 | Falossi et al. | 439/362 |
| 5,411,401 | 5/1995 | Chiou | 439/76 |
| 5,452,975 | 9/1995 | Grant | 411/22 |
| 5,775,931 | 7/1998 | Jones | 439/358 |
| 5,921,801 | 7/1999 | O'Sullivan et al. | 439/362 |

*Primary Examiner*—Khiem Nguyen
*Assistant Examiner*—Brian S. Webb
*Attorney, Agent, or Firm*—Paul A. Revis

[57] ABSTRACT

A cable connector system for connecting a cable to an electronic component through a plug coupled to the cable and a receptacle coupled to the electronic component. The plug provides a unique structure that is easily connected to the receptacle without the use of tools. Additionally, the plug provides cover over the end of the plug to which the cable is connected so that the plug may be easily pulled past obstructions with which a conventional plug could become entangled.

23 Claims, 7 Drawing Sheets

TANGLE RESISTANT CABLE CONNECTOR

TECHNICAL FIELD

The present invention is directed toward a cable connector system for connecting electronic components that by its design resists becoming entangled with other parts when unplugged and pulled past the other parts.

BACKGROUND OF THE INVENTION

Machines with more than one component that transfer large amounts of data by electronic means such as computers necessarily are connected by a plurality of wires. It has become common to make connections between computer component cables by use of standardized plugs. Typically, a male plug on one end of a component cable with a plurality of wires, commonly referred to as pins, is plugged into a female receptacle on a first component. There is typically another plug on the other end of a component cable that can be inserted into a receptacle on a second component. By this arrangement, the first component and the second component can electronically communicate via the component cable.

A problem with such connections is that the connections can become dislodged during routine use. To resolve the problem of disconnection, a means of fixing the plug and the receptacle together was devised and is employed in a vast majority of computer cable plug connections. The solution is to attach a pair of posts with interior threads to a component, one post on either side of the receptacle. The receptacle is also attached to the component. A pair of bolts designed to mate with the interior threads attached to the component is attached to the male plug. The bolts are free to turn, but when the bolts are tightened into the interior threads, the plug is forced against the receptacle. The head of the bolts urge the plug toward the posts with interior threads when the bolts are tightened.

In early designs, the heads of the bolts were conventional bolt heads that required a wrench or screwdriver to tighten. However, later designs replaced conventional bolt heads with finger operable bolt heads. To provide a greater gripping surface for an operator to grasp, the later designs provided a lengthened bolt head. The lengthened bolt head, as shown in FIG. 1, creates a space 100 bordered on three sides by parts of the plug or the cable. This space effectively forms a hook.

In the ordinary connection and use of computer components, it is likely that connection cables will become twisted about one another and will intersect with one another. It is also common for a cable to require disconnection and removal from a computer component. This may occur in situations where a component is to be repaired or replaced or in situations where an entire system is to be moved. Because components are usually hooked near the back of a computer system, it is often difficult to access the full length of a cable to be disconnected. Therefore, to remove the cable, the cable may first be detached from a component and then pulled by the cable from the cable's opposite end past the other cables and the edges of the computer components and other machinery. The parts of a typical plug when pulled through the maze of cables, components, and machinery then snag and prevent the cable from being removed as planned. The hook formed by the lengthened bolt head, plug, and cable works as a grappling hook to snag any obstruction coming within the space 100 within the bolt head, plug, and cable.

Another factor contributing to the snagging of cables removed in the manner described above is choice of material from which a plug is constructed. An optimal material should be durable, but should not have a finish with a high coefficient of friction.

The prior art has failed to supply a product that is both operable without the use of tools and provides a structure that resists snagging when pulled past obstructions by the cable. U.S. Pat. No. 5,219,242 illustrates a structure with a reduced susceptibility to snagging. However, the device shown requires a tool for operation such as a screwdriver. U.S. Pat. No. 5,411,401 shows a structure with finger-operable screws. However, the structure disclosed in the '401 patent is not effective at reducing a propensity to hook or snag when the plug is pulled past obstructions by the cord. In fact, the structure disclosed in the '401 patent is not intended to limit snagging when being pulled by the cord. The '401 patent merely discloses a means of connecting a plurality of cords and an additional circuit board to a computer component. Not only are the back edges of the plug squared so as to create obstacles, but also the bolt heads extend out beyond the body and create obstructions.

An improved device, therefore, would provide a covering over the elongated bolt heads in order to eliminate the spaces 100 as described above. In an improved structure, the bolts or latching members would be operable without the use of tools. Additionally, an improved device would have rounded comers facing an anticipated direction of pull for the cable so that squared surfaces would not hook on other cables, components, or machinery. Furthermore, an improved device would be constructed of a durable material, but also a material that has a relatively low coefficient of friction.

SUMMARY OF THE INVENTION

An embodiment of the invention is a cable plug for connecting a cable to a receptacle. The cable plug has a body with a connector located at a first end of the body. The body also has an opening through a second end of the body for passing a cable. The second end of the body is opposite from the first end. The body also has a cavity in a side of the body. The side of the body is adjacent to the first end of the body. The cable plug has a bolt rotatably attached to the body. The bolt has a threaded shaft at a first end and a head at a second end. Additionally, the entire head of the bolt is located within the cavity.

In some embodiments of the invention, there is a cable connector system for connecting a cable to an electronic component comprising a plug and a receptacle. The plug is coupled to the cable wherein the plug has a body with a connector located at a first end of the body. The plug also includes an opening through a second end of the body for passing a cable. The opening is located at a second end of the body, the second end being opposite from the first end. The body also has a cavity in a side of the body, the side being adjacent to the first end. The plug has a member attached to the body, the member having a first end for extending from a first end of the body and a second end on the opposite end from the first end. All of the second end of the member is located within the cavity.

The receptacle is coupled to the electronic component. The receptacle is for connecting with the plug. The receptacle has a member mate for accepting the first end of the member so that by attaching the member the plug is connected to the receptacle. The receptacle also includes a jack for accepting the connector for making electrical connection between the cable coupled to the plug and the electronic component coupled to the receptacle.

Still another embodiment of the invention is a cable connector system for connecting a cable to an electronic component. The system includes a means for coupling the cable to a plug and a means for connecting the plug to a receptacle coupled to the electronic component. Additionally, the system includes a means for pulling the cable and the plug by the cable so that obstruction of movement of the plug is reduced when the plug and the cable are pulled by the cable along side of a wire, a component, or machinery that provide surfaces on which the plug could hook if the plug formed a hooking mechanism.

DETAILED DESCRIPTION OF THE INVENTION

Embodiments of the present invention are directed toward a cable connector system for connecting a cable to an electronic component. Embodiments provide a novel structure that allows for securely connecting a plug with an attached cable to a receptacle that is coupled to an electronic component. The invention enables operation of the device without the use of tools such as wrenches or screwdrivers. Furthermore, embodiments of the invention present a unique structure that does not easily snag or hook on other obstructions when the plug is pulled by the cable coupled to the plug, the cable and plug being pulled past the other obstructions.

DESCRIPTION OF EMBODIMENTS OF THE CABLE CONNECTOR SYSTEM

Figure 1:
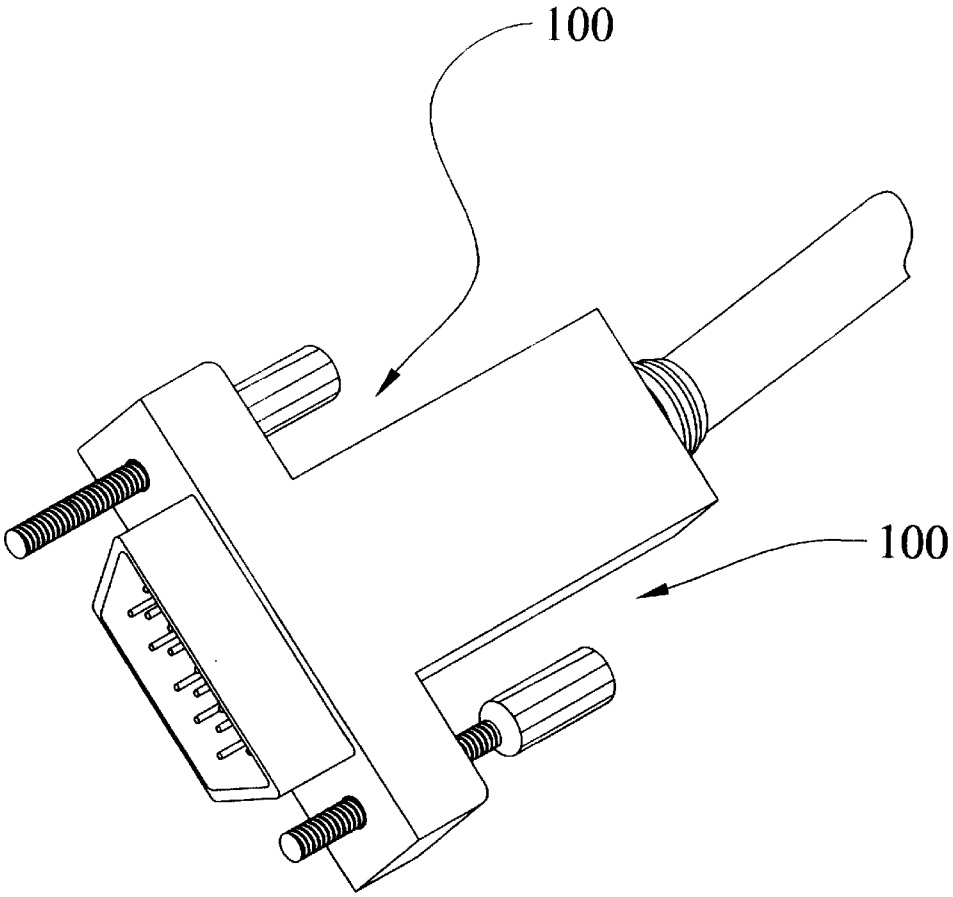
Fig. 1 (Prior Art)
FIG. 1 is a perspective view of a prior art connector plug.
Figure 2:
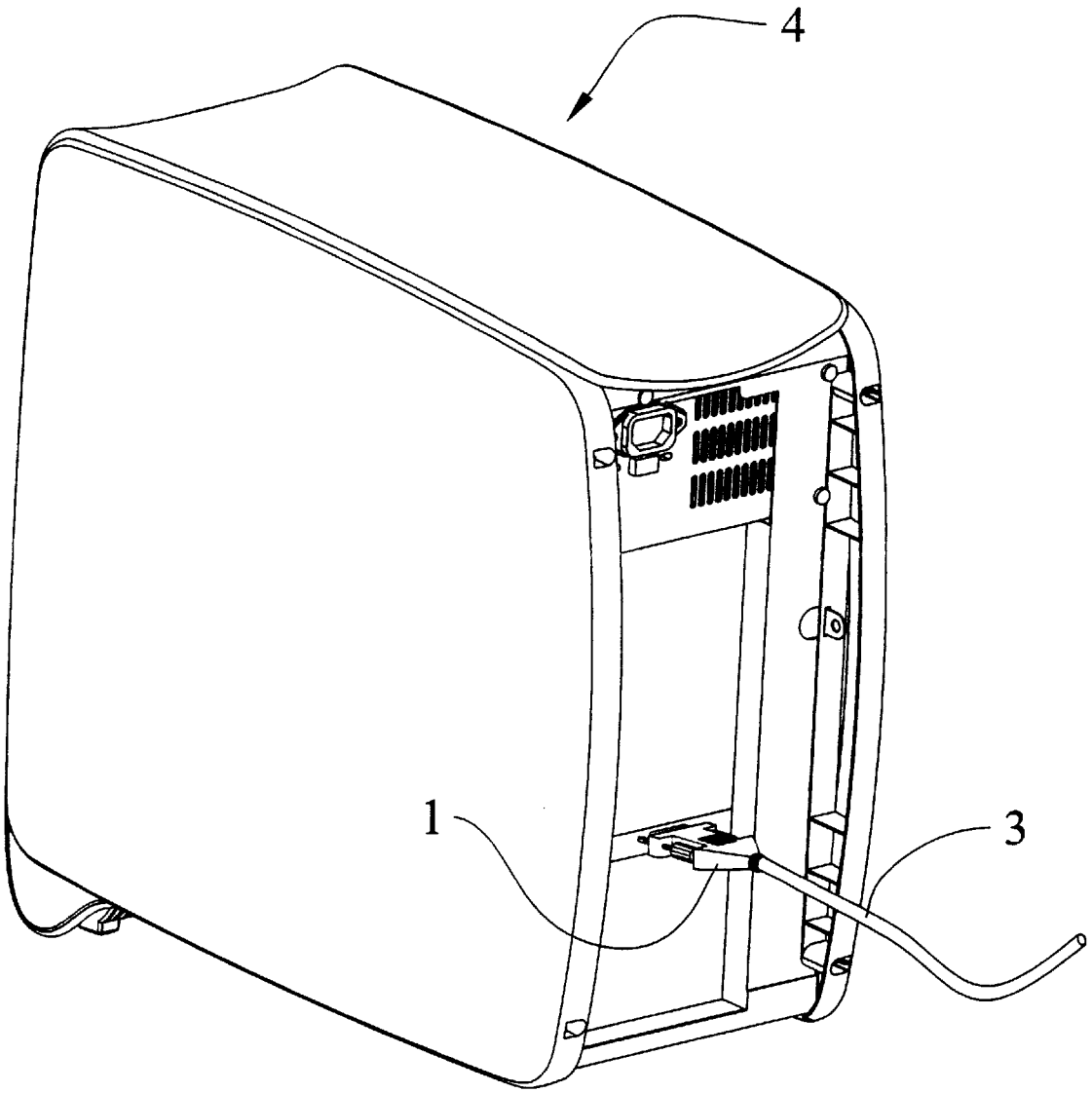
FIG. 2 is a perspective view of a cable connector system with a plug and a cable attached to the back of an electronic component.
Figure 3:
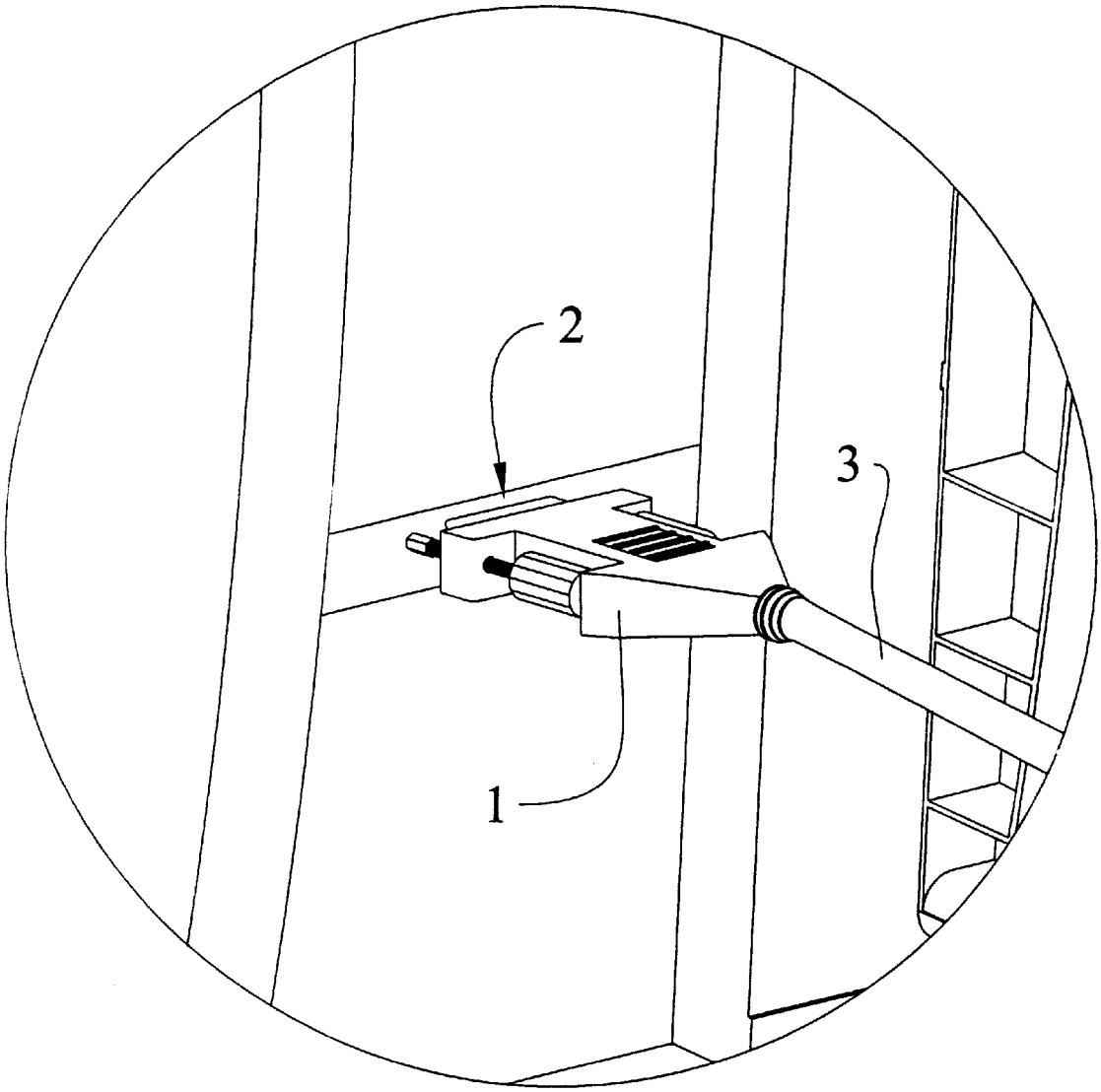
FIG. 3 is an enlarged perspective view of the cable connector system shown in FIG. 2.
Figure 5:
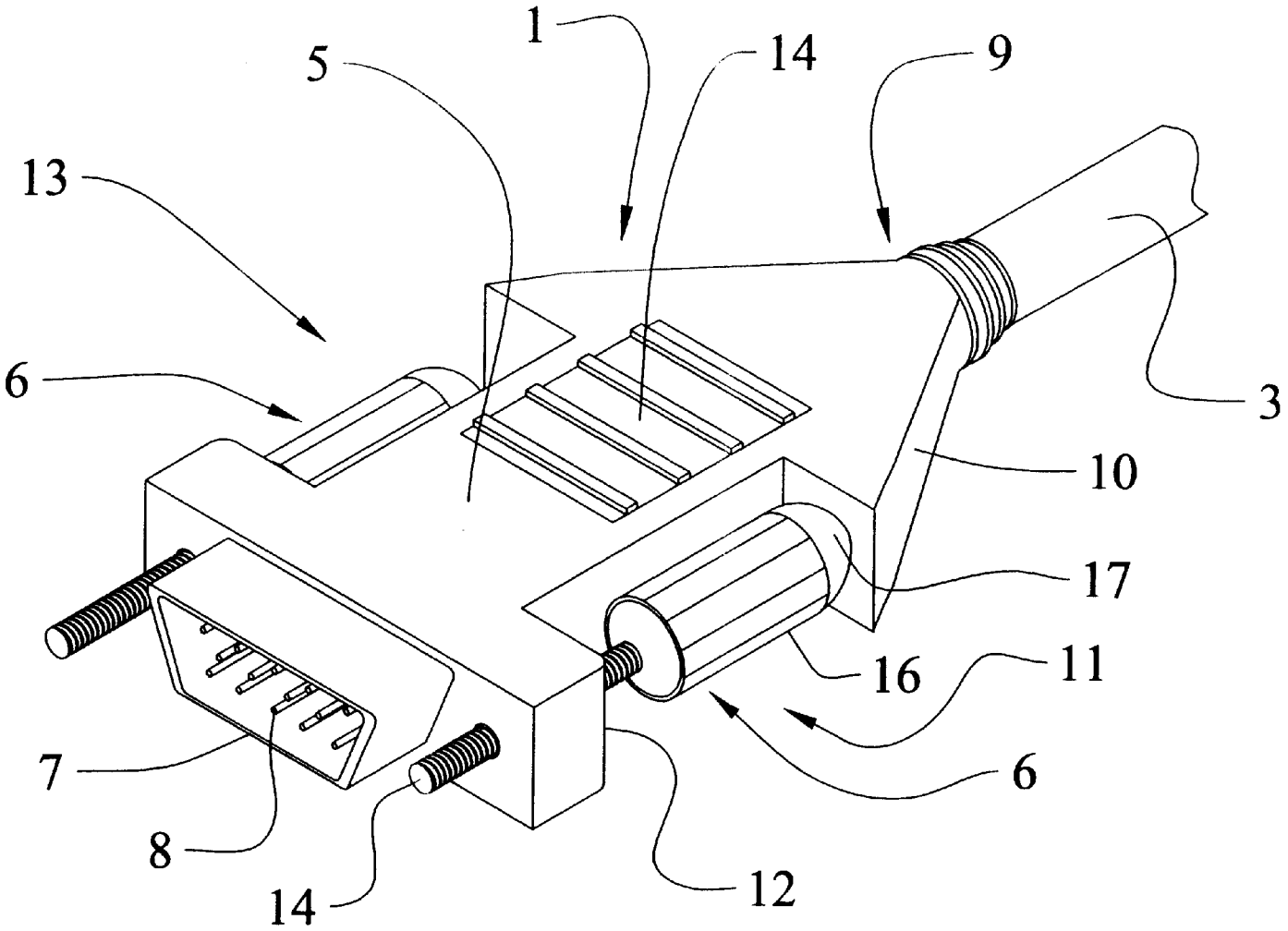
FIG. 5 is a perspective view of an embodiment of the plug and cable.

FIG. 2 shows a cable connector system for connecting a cable 3 to an electronic component 4. As shown in FIGS. 2, 3, and 5, a plug 1 is coupled to the cable 3, and a receptacle 2 is coupled to the electronic component 4.

Cable

The cable 3 may be any cable or medium for transmitting signals between or among electronic components. A typical cable consists of a plurality of insulated metallic wires bundled together in a common insulating tubular encasement. The transmitting medium might also be a light transmitting cable such as a fiber optical cable. The cable could also be a sound or mechanical force transmitting structure or any cable that would be useful in transmitting information to an electronic component.

Electronic Component

The electronic component 4 shown in FIG. 2 is a personal computer. Typically, personal computers have multiple cables attaching various devices within the computer to other portions of the computer system such as the monitor or to peripherals like a printer. For clarity FIG. 2 shows only a single cable connection. The invention is not limited to a single cable connection. A number of cable connections may be employed with a single electronic component. Types of electronic components on which the cable connector system could be used include but are not limited to computers, computer monitors, flat panel displays, server hubs, printers, typewriters, telephones, television sets, video cassette recorders, stereo system components, optical disk players, and the like.

Plug

An enlarged view showing details of the plug 1 is shown in FIG. 5. In the embodiment illustrated, the plug 1 has a body 5 and two members 6 extending from the body 5 for attaching to a portion of the receptacle 2.

Body

As shown in FIG. 5, the body 5 has a connector 7 at a first end of the body 5. The connector 7 illustrated is a typical multi-pin male connector, or pin connector. Each pin 8 aligns with a hole in a receptacle to which the connector 7 can be connected. The number of pins varies with the particular application and the invention is not limited to use with a plug with any specific number of pins. The connector 7 may be any type of connector capable of making connection over which a signal may be transmitted.

There is an opening through a second end 9 of the body 5 for passing the cable 3. The second end 9 is on the opposite end of the body 5 from the first end and the connector 7. The opening may be a round opening. Additionally, the opening may be of a diameter substantially equivalent to the cable 3. In some embodiments, the opening may be of a diameter slightly larger than the cable 3 so that the cable may easily pass through the opening. In other embodiments, the opening may be slightly smaller than the cable 3 so that by passing the cable 3 through the opening the opening is stretched to form a compression fit with the cable 3.

A longitudinal axis of a portion of the cable 3 extending from the plug 1 will form an obtuse angle with a surface 10 of the second end 9 of the body 5 in some embodiments of the invention. This construction of the body 5 provides a means of reducing obstruction of movement of the plug 1 and cable 3 when the plug 1 is pulled by the cable 3 through such obstructions as wires, computer components, or machinery. Such obstructions provide surfaces on which a plug could hook. The angled surface 10 forms a swept back surface, that unlike conventional plug ends, does not tend to hook or catch other obstructions when a plug is pulled past the obstructions. Instead, the surface 10 tends to wedge through such obstructions.

Embodiments of the invention also have a first cavity 11 in a side of the body 5. The side having the first cavity 1 1 may be adjacent to the first end of the body 5 as shown in FIG. 5. Another feature of the first cavity 11 is that it may have a rounded outside corner 12 to lessen the chances of the first cavity 11 acting as a hook. The invention may also have a second cavity 13 in a second side of the body 5. The second side of the body 5 is on the opposite side of the body from the first side.

The body 5 may also include a gripping surface 14 where at least a portion of the body is an elastomer for improving the ability to grip the body to remove the body from the receptacle 2. Examples of an elastomer include polyisoprene (natural rubber), polybutadiene, polyisobutylene, and polyurethanes. The gripping surface 14 may be made from a material other than an elastomer. The purpose of the material is to provide an increased coefficient of friction between an operator's fingers and the plug. As shown in FIG. 5, the gripping surface may have raised surfaces to improve the ability to grip the body. The raised surfaces may be in addition to or in lieu of use of a material with an increased coefficient of friction such as an elastomer.

In contrast, the body 5 may be formed from a material with a coefficient of friction equal to or less than a poly (vinylidene fluoride) plastic. The purpose of use of such a material is to reduce the likelihood that the plug will grip or "stick" to obstructions past which the plug may be pulled. A poly(vinylidene fluoride) plastic is a material commonly used to insulate electrical wires and conductors.

In some embodiments, the body may be formed from two opposing halves between which other parts of the plug are held. The body may be assembled by arranging all of the parts in there proper positions and then joining the sides together. The halves may be joined together by any means including but not limited to screws, clips, or adhesive.

Member

Figure 6:
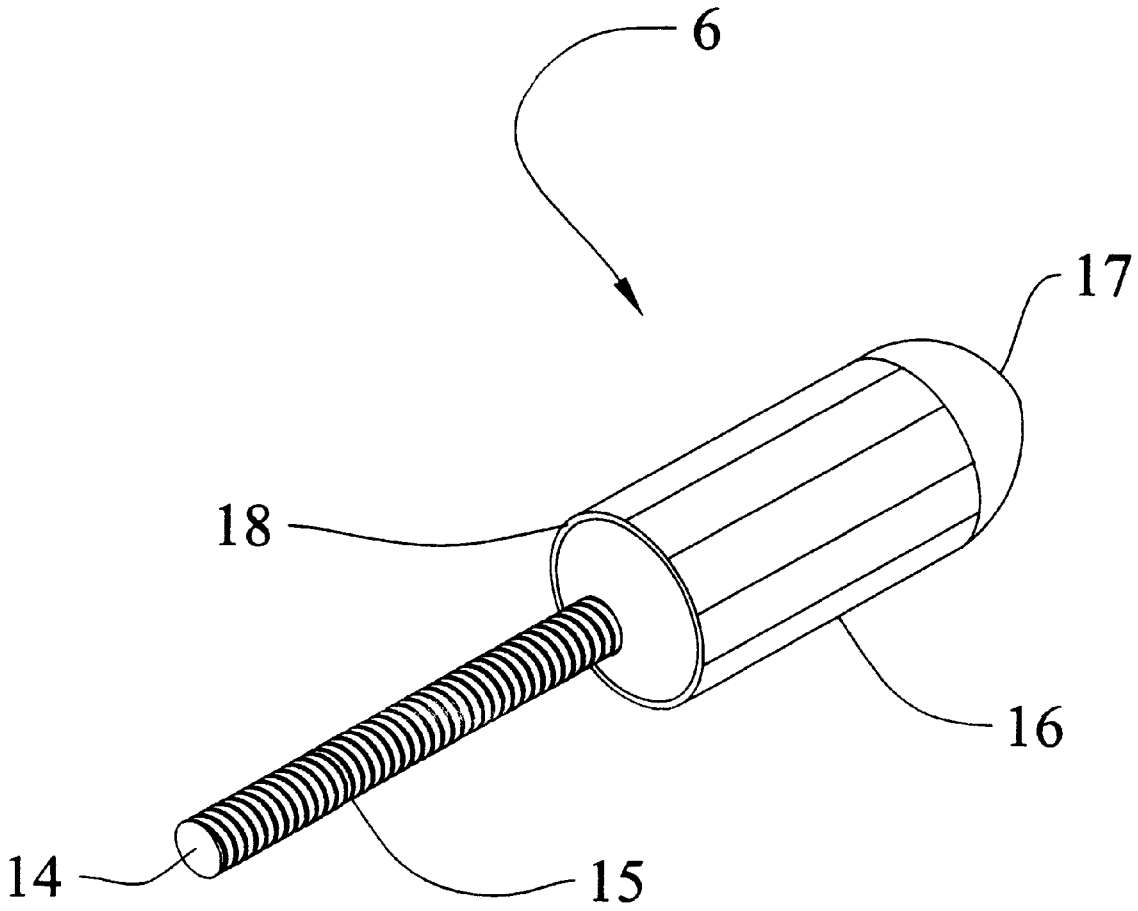
FIG. 6 is a perspective view of a bolt of the plug of the cable connector system.

As shown in FIG. 5, a member 6 has a first end 14 that extends from the first end of the body 5. The member 6 may be a bolt rotatably attached to the body 5. In other embodiments, the member 6 could be any type of member extending from the first end of the body 5 that is capable of connecting the body to another object. Examples of other types of connecting members include a clamp or an extrudable pin that in response to linear pressure expands to engage an opening in another object. As shown in FIG. 6, the member 6 is a bolt with a threaded shaft 15 at the first end 14 and a head 16 at the second end 17. The head 16 may be an elongated head with a cylindrical gripping surface 18. The cylindrical gripping surface 18 may be formed from an elastomer or some other material that would enhance the ability to grip and turn the member 6. Additionally, the cylindrical gripping surface 18 may have textured portions that further enhance the ability to grip and turn the member 6.

In the embodiment of the invention illustrated in FIG. 5, the entire second end 17 of the member 6 is located within the cavity 11. Such an arrangement is advantageous because it prevents the member 6 from extending beyond the edges of the body 5 where it could hook obstructions past which the plug 1 may pass when being pulled by the cable 3. The edge of the second end 17, which may be referred to as the edge of the head 16 of the bolt, may be rounded to further help prevent the member 6 from obstructing movement of the plug 1 when the plug is pulled by the cable 3.

Figure 7:
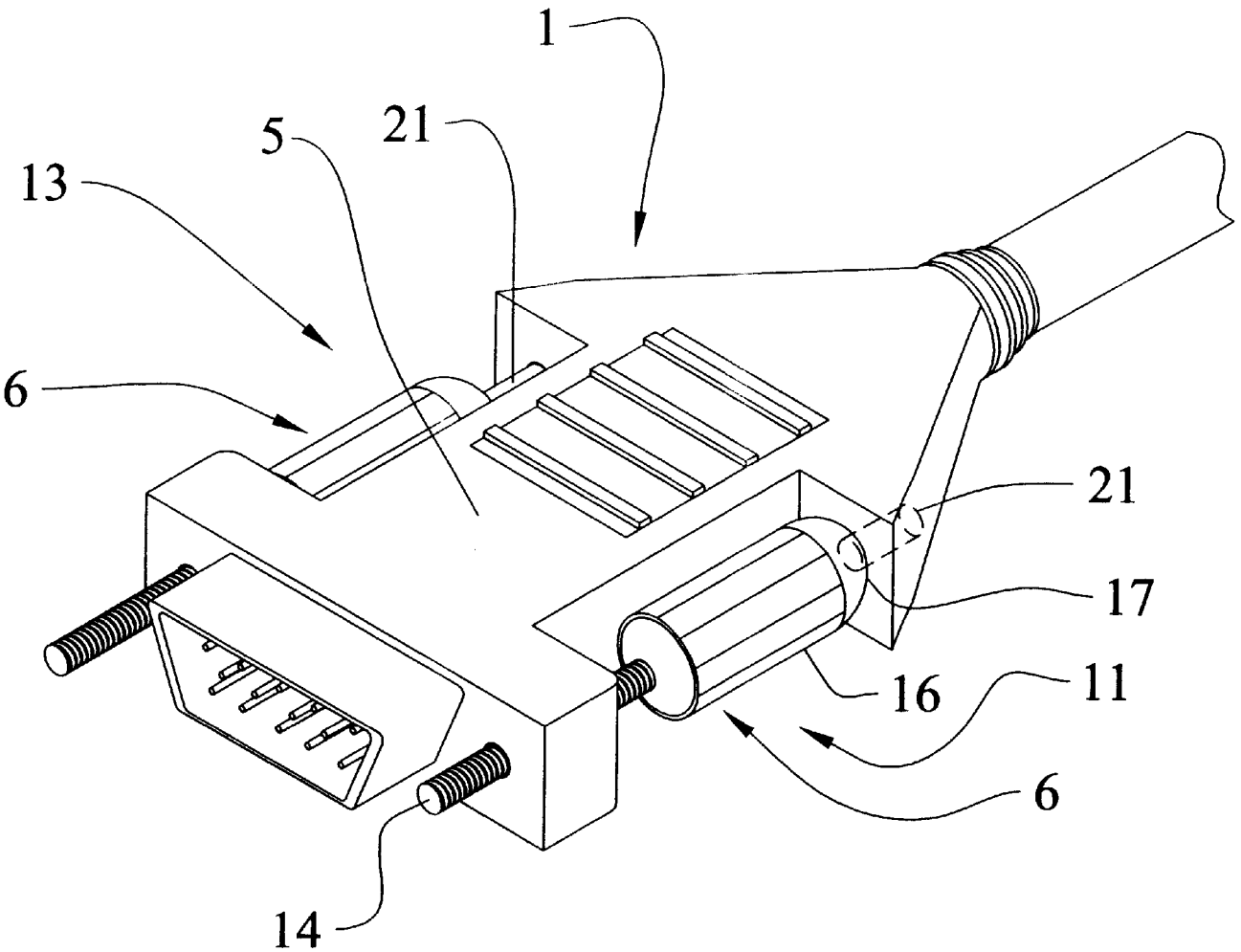
FIG. 7 is a perspective view of an embodiment of the plug and cable.

In the embodiment shown in FIG. 7, the member 6 also includes a pivot shaft 21 connected to the head 16 and extending from the second end 17 of the member. The pivot shaft 21 is for rotatably connecting to the body 5. The pivot shaft 21 may also provide an advantage in further excluding cables or components from full entry into the first cavity 11 and the second cavity 13 when the members 6 are pushed furthest toward their first end 14. The pivot shaft 21 would be particularly advantageous when small cables such as telephone lines may be encountered.

Receptacle

Figure 4:
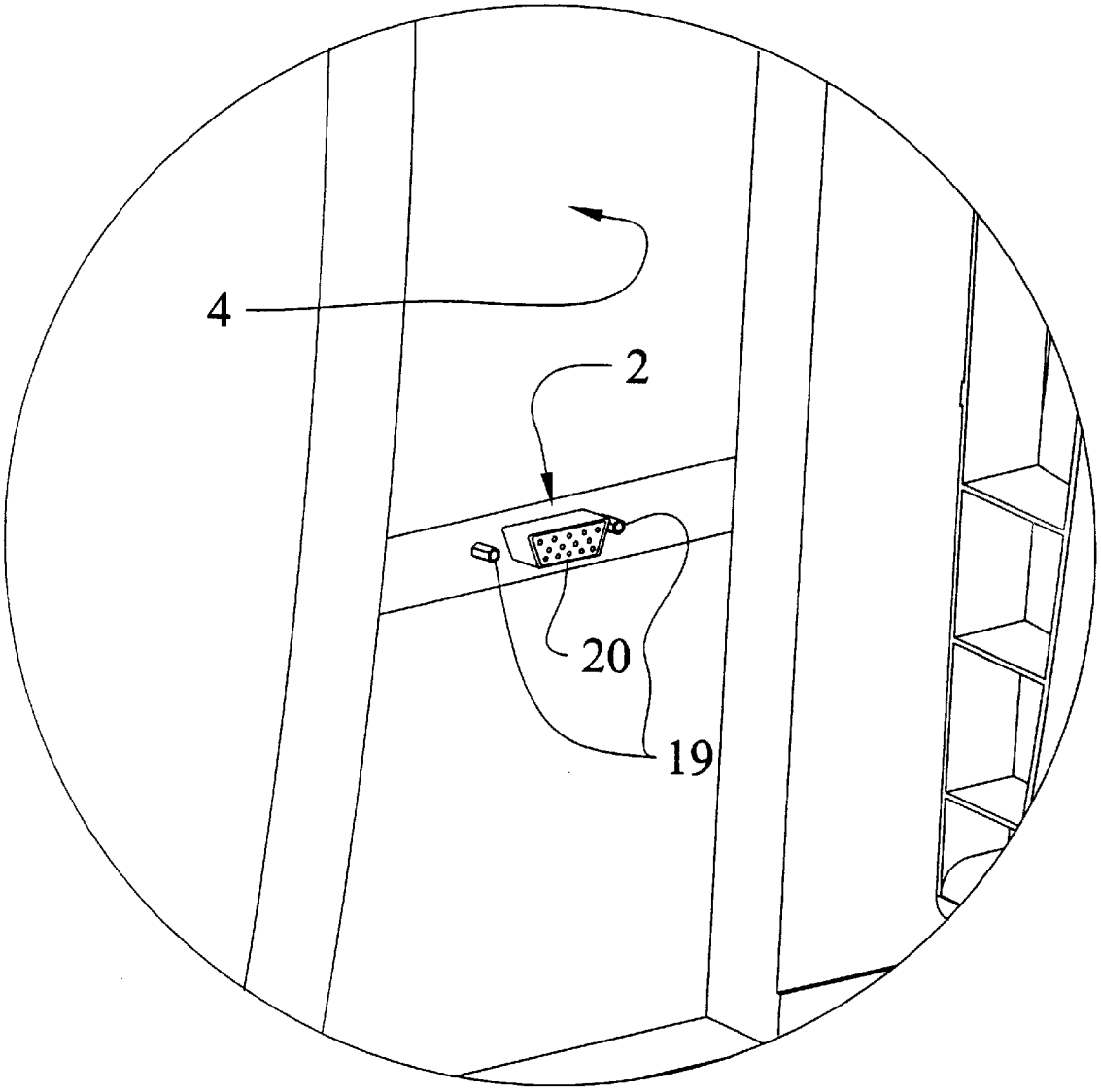
FIG. 4 is an enlarged perspective view of a receptacle of the cable connector system shown in FIG. 2 with the plug and cable removed for clarity.

As shown in FIG. 4, the cable connector system includes the receptacle 2 coupled to the electronic component 4. The receptacle 2 is for connecting with the plug 1. The receptacle 2 includes a member mate 19 and a jack 20.

Member Mate

The member mate 19 is coupled to the electronic component 4 for accepting the first end 14 of the member 6. By attaching the member to the member mate the plug 1 is connected to the receptacle 2. As shown in FIGS. 2–4, the member mate 19 is a post with interior threads for accepting the threaded shaft 15 of the member 6. With the illustrated arrangement, the plug 1 is tightened against the receptacle 2 by tightening the bolt 6. In other embodiments with other types of members as described above, a member engages the member mate by various means to connect the plug 1 to the receptacle 2. The member mate 19 may be a mate specialized to engage a particular type of member or simply an opening that can accept a member. In some embodiments, two member mates may be employed to increase connection strength between the plug 1 and the receptacle 2.

FIG. 5 shows two members 6, one on each side of the connector 7. As illustrated, the member 6 on the far side is pushed forward to a position where it would be attached to a member mate 19. This attachment is shown in FIGS. 2 and 3. The member on the near side of the connector 7 is positioned to be connected, but is not yet connected to a member mate in the illustrations.

Jack

The jack 20 of the receptacle 2 shown in FIG. 4 is a jack for accepting the connector 7 shown in FIG. 5. By connecting the connector 7 to the jack 20, electrical connection is made between the cable 3 and the electronic component 4. The jack 20, best illustrated in FIG. 4, is a computer pin jack. As discussed in association with the connector 7 above, jack 20 may be any type of jack capable of making connection with a connector over which a signal may be transmitted.

From the foregoing it will be appreciated that, although specific embodiments of the invention have been described herein for purposes of illustration, various modification may be made without deviating from the spirit and scope of the invention. Accordingly, the invention is not limited except as by the claims.

Advantages of the Invention

The invention demonstrates an advantageous combination of functions by providing a unique structure. The invention provides enlarged member gripping surfaces that enable connection of the plug to the receptacle without the use of tools such as screwdrivers or wrenches. In addition, the enlarged members and member gripping surfaces are covered by other portions of the structure so that the space typical in conventional plugs that tends to hook obstructions is prevented from doing so. The device also has rounded corners facing an anticipated direction of pull for the cable so that squared surfaces that could hook on other cables, components, or machinery are reduced. It is also advantageous that the plug is constructed from durable materials, but material that have relatively low coefficients of friction so that the plug tends not to snag on other obstructions when pulled past the obstructions.

What is claimed is:

1. A cable connector system for connecting a cable to an electronic component comprising:

a plug coupled to the cable wherein said plug comprises:

a body including:

a pin connector located at a first end of said body, an opening through a second end of second end being opposite from the first end, and a cavity in a side of said body, the side being adjacent to the and a bolt rotatably attached to said body, said bolt having a threaded shaft at a first end and a head at a second end, wherein the entire head of said bolt is located within the cavity, wherein at least a portion of the second end of said body adjacent to the cable forms a surface at an obtuse angle with the longitudinal axis of a portion of the cable extending from the plug, wherein an end of the elongated head of the bolt distal from the threaded shaft is rounded; and a receptacle coupled to the electronic component, said receptacle for connecting with said plug wherein said receptacle comprises:

a post with interior threads for accepting the treaded shaft so that by tightening the bolt, said plug is tightened against said receptacle, and a pin jack for accepting the pin connector for making electrical connection between the cable coupled to said plug and the electronic component coupled to said receptacle.

2. A cable plug for connecting a cable to a receptacle comprising:

a body including:

a connector located at a first end of said body;

an opening through a second end of said body for passing a cable, the second end being opposite from the first end, and a cavity in a side of said body, the side being adjacent to the first end; and a bolt rotatably attached to said body, said bolt having a threaded shaft at a first end and a head at a second end;

wherein the entire head of said bolt is located within the cavity;

wherein at least a portion of the second end of said body adjacent surface at an obtuse angle with the longitudinal axis of a portion of the cable extending from the plug.

3. The cable plug of claim 2 wherein said connector is a pin connector for connecting electronic components.

4. The cable connector system of claim 2 wherein the cavity in a side of the body has a rounded outside corner.

5. The cable plug of claim 2 wherein said body includes a gripping surface where at least a portion of said body is an elastomer for improving the ability to grip said body.

6. The cable plug of claim 2 wherein said body includes a second cavity in a second side of said body, the second side being adjacent to the first end.

7. The cable plug of claim 2, wherein the opening is a round opening of a diameter substantially equivalent to the cable for passing through the hole.

8. The cable plug of claim 2, wherein the head is an elongated head with a cylindrical gripping surface, the head being elongated to enhance the ability to grip and turn the head.

9. The cable plug of claim 8, wherein the cylindrical gripping surface is an elastomer.

10. The cable plug of claim 2, wherein an edge of the head is rounded.

11. The cable plug of claim 2, wherein said bolt further comprises a pivot shaft connected to the head and extending from the second end of said bolt, the pivot shaft for rotatably connecting to said body.

12. A cable connector system for connecting a cable to an electronic component comprising:

a plug coupled to the cable wherein said plug comprises:

a body including:

a connector located at a first end of the body, an opening through a second end of the body for passing a cable, the second end being opposite from the first end, and a cavity in a side of the body, the side being adjacent to the first end, and a member attached to the body, the member having a first end for extending from the first end of the body and a second end on the opposite end from the first end, wherein at least a portion of the second end of the body adjacent to the cable forms a surface at an obtuse angle with the longitudinal axis of a portion of the cable extending from the plug, wherein the entire second end of the member is located within the cavity; and a receptacle coupled to the electronic component, said receptacle for connecting with said plug wherein said receptacle comprises:

a member mate for accepting the first end of the member so that by attaching the member said plug is connected to said receptacle, and a jack for accepting the connector for making electrical connection between the cable coupled to said plug and the electronic component coupled to said receptacle.

13. The cable connector system of claim 12, wherein said connector is a pin connector for connecting electronic components.

14. The cable connector system of claim 12, wherein the cavity in a side of the body has a rounded outside corner.

15. The cable connector system of claim 12, wherein the body includes a gripping surface where at least a portion of the body is an elastomer for improving the ability to grip the body to remove the body from the receptacle.

16. The cable connector system of claim 12, wherein the body includes a second cavity in a second side of the body, the second side being adjacent to the first end.

17. The cable connector system of claim 12, wherein the opening is a round opening of a diameter substantially equivalent to the cable for passing through the hole.

18. The cable connector system of claim 12, wherein the member is a bolt rotatably attached to the body, the bolt having a threaded shaft at the first end and a head at the second end, the treaded shaft extending from the second end of the body.

19. The cable connector system of claim 12, wherein the second end of the member is an elongated head with a cylindrical gripping surface, the second end of the member being an elongated head to enhance the ability to grip and turn the member.

20. The cable connector system of claim 19, wherein the cylindrical gripping surface is an elastomer.

21. The cable connector system of claim 12, wherein an edge of the second end of the member is rounded.

22. The cable connector system of claim 12, wherein the member mate is a post with interior threads for accepting the treaded shaft so that by tightening the bolt, said plug is tightened against said receptacle.

23. A cable connector system for connecting a cable to an electronic component comprising:

a means for coupling the cable to a plug;

a means for connecting the plug to a receptacle coupled to the electronic component; and a means for reducing the obstruction of movement of the plug when the plug of the plug is reduced when the plug and the cable are pulled by the cable along side a wire, a component, or machinery that provide surfaces on which the plug could hook if the plug formed a hooking mechanism, wherein at least a portion of the plug that is adjacent to the cable forms a surface at an obtuse angle with the longitudinal axis of a portion of the cable extending from the plug.

* * * * *